United States Patent [19]

Prader

[11] 4,421,805

[45] Dec. 20, 1983

[54] SLIP-RESISTANT SHIPPING SACKS

[75] Inventor: Randolph D. Prader, Fairport, N.Y.

[73] Assignee: Mobil Oil Corporation, New York, N.Y.

[21] Appl. No.: 372,873

[22] Filed: Apr. 29, 1982

[51] Int. Cl.[3] ..... B32B 5/12; B65D 33/02

[52] U.S. Cl. ..... 428/35; 106/36; 206/524.2; 206/524.3; 229/DIG. 11; 383/116; 383/119; 383/32; 428/110; 428/294; 428/476.9

[58] Field of Search ..... 106/36; 206/503, 524.2, 206/524.3; 428/476.9, 110, 294, 35; 229/53, 55, DIG. 11

[56] References Cited

U.S. PATENT DOCUMENTS

| | | | |
|---|---|---|---|
| 3,525,467 | 8/1970 | Bennett et al. | 229/53 |
| 3,598,677 | 8/1971 | Bergmeister et al. | 106/36 |
| 3,642,679 | 2/1972 | Young | 229/53 |
| 3,761,441 | 9/1973 | D'Allessandro et al. | 106/36 |
| 4,161,559 | 7/1979 | Bosse | 428/110 |
| 4,229,567 | 10/1980 | Sharkey | 428/476.9 |
| 4,322,480 | 3/1982 | Tuller et al. | 428/476.9 |

*Primary Examiner*—William R. Dixon, Jr.
*Attorney, Agent, or Firm*—A. J. McKillop; M. G. Gilman; J. F. Powers, Jr.

[57] ABSTRACT

A shipping sack comprising an envelope of plastic film having at least one surface thereof at least partially coated with a thin layer of a slip-resistant polyamide resin.

10 Claims, No Drawings

SLIP-RESISTANT SHIPPING SACKS

BACKGROUND OF THE INVENTION

The present invention relates to slip-resistant shipping sacks and to a method of preventing or inhibiting the tendency of product filled sacks from shifting position with respect to another surface or with respect to one another.

Heavy duty shipping sacks designed to be filled with various products, such as animal feed, fertilizer, etc., particularly sacks made of thermoplastic sheet material, can exhibit low friction between surfaces in relation to each other and to other surfaces in which they come into contact during movement. Loaded sacks of this type when stacked onto pallets or hand carts have a tendency to shift position and fall off during transportation of the sacks. This obviously results in loss of time and, in many instances, a breaking open of the sacks, causing overall loss of efficiency. Bag slippage on inclined conveyors also is a problem.

It is an object of the present invention to provide a product sack, the surfaces of which are resistant to ordinary slippage during the handling, stacking, or transportation of the same.

A further object of the present invention is to provide a method for stabilizing at least one loaded shipping sack during handling, stacking or transportation from one point to another.

SUMMARY OF THE INVENTION

In accordance with the present invention, there is provided a product or shipping sack comprising an envelope of plastic film having at least one surface thereof at least partially coated with a thin layer of a slip-resistant thermoplastic polyamide resin.

In accordance with the present invention there is also provided a method of stabilizing at least one loaded shipping sack against motion relative to surfaces in contact therewith comprising, applying to at least one surface thereof a thin layer of a slip-resistant polyamide resin.

DETAILED DESCRIPTION OF THE INVENTION

The product or shipping sacks of the present invention are typified by thermoplastic sacks which are generally longer than they are wide. They are formed of a tube which is sealed at the bottom and designed to be closed in some suitable fashion at the top after the product has been filled into the sack. The particular sack shape or design is not important. The sacks are designed to carry products weighing anywhere from a few pounds up to about 125 pounds. While the materials from which the bags are made may vary widely, the present invention is concerned with bags made from any material which tend to slip or causing sliding during bag handling or transportation. An example of the bag materials and bags contemplated for improvement by the present invention is described in copending Patent Application Ser. No. 307,417, filed Oct. 1, 1981, now U.S. Pat. No. 4,397,703 the subject matter of which is incorporated herein by reference in its entirety. Such bags are designed to ship a variety of materials, for example, grain, cement, fertilizer, peat moss, minerals, chemicals, plastic resins, etc. Such sacks can be made from single-ply 1–10 mil low density polyethylene or a low density polyethylene/high density polyethylene co-extruded film or a cross-laminated, machine direction-oriented high density polyethylene film. Reinforced composite sheets are also available for such sacks, as described, for example, in U.S. Pat. No. 4,161,559. Whatever film sheet is selected for the bag material, the film may be converted into a tube either by sewing or by hot-melt gluing along the edges. This tube may then be fed to a bag-making operation which can produce bags of the desired sizes and strength properties by sewing or gluing along the bottom and top edges of the bags.

A preferred film sheet is a composite comprising a pair of co-extruded films having a heat-softenable inner layer, a plurality of machine-direction fibers therebetween having a selected first denier and a selected first spacing therebetween, and a single transverse-direction fiber disposed as parallel reaches connected by 180° loops at each end, said parallel reaches having a selected second spacing therebetween, said loops being entirely enclosed by said pair of films, and said transverse-direction fiber having a selected second denier. The first and second deniers can be from 350–1200 and the film sheet can have a thickness of from about 0.5–5 mils. The films can be composed of 25% high density polyethylene and 75% low density polyethylene and the fibers can be of polypropylene. It is preferred that the fibers are in the form of tapes.

It has been determined that shipping sack-slipperiness on pallets and hand carts can be overcome to a significant extent by the use of a particular class of thermoplastic polyamide resins. The polyamide resin is formed by the condensation of a dimerized vegetable acid and an aliphatic polyamine. The fatty acid component of the polyamide resin contains two or more ethylenic groups and may be derived from vegetable oil such as tall oil. Such a vegetable oil contains substantial quantities of high molecular weight unsaturated fatty acids which are particularly suited for use in the formation of the polyamide resins of interest herein. Illustrative examples of common high molecular weight fatty acids containing two or three ethylenic groups include linoleic acid, linolenic acid and alpha- and beta-eleostearic acid. These acids may be polymerized by the application of heat to provide a polymerized addition product which is largely dimerized or trimerized. Dimerized linoleic acid is the particularly preferred polymerized fatty acid for use in the formation of the subject polyamide anti-slip agents. Most preferred is the dimerized acid obtained from tall oil.

The aliphatic polyamine which is condensed with the dimerized fatty acid is preferably a diamine having from $C_1$ to about $C_8$ carbon atoms. For example, suitable primary diamines include methylene diamine, ethylene diamine, propylene diamine, tetramethylene diamine, pentamethylene diamine, hexamethylene diamine, and octamethylene diamine. Aliphatic polyamines containing three or more primary secondary amine groups may also be utilized. The resulting amides contain secondary amide functional groups on saturated aliphatic long hydrocarbon chains. They contain no detectable free amino groups but may contain some minor amounts of free acid. A particularly preferred material is a thermoplastic polyamide resin sold under the name Versamide 712 by Resins Division, Henkel Corp., Minneapolis Minn. This material has Brookfield viscosity at 160° C.-poise of 5.0–8.0; a Softening Point, °C. of 98–108; a Gardener color-maximum of 7; and an Appearance of clear.

The solvent or dispersant for the polyamide is not critical so long as it effectively permits the application of a thin film of the polyamide to the shipping sacks on evaporation of said solvent or dispersant. The concentration of the polyamide in the solvent must be such that a layer of the polyamide can be applied to the surface of the shipping sack so as to increase the coefficient of friction between the surface of the shipping sack and another surface or another shipping sack. Generally, the amount of thermoplastic polyamide resin will be form about 20% to about 40% by weight of the resin solvent system. Examples of suitable solvents include methyl, ethyl, propyl, butyl, etc., alcohols, alone, or mixed with a co-solvent or dispersant, such as, heptane. A particularly preferred solvent combination is a 50—50 mixture of isopropyl alcohol or normal propyl alcohol with heptane.

After an appropriate amount of the thermoplastic polyamide resin is dissolved in the solvent, application to the sack surface can be accomplished by any convenient means. For example, it can be applied by paint brush, paint roller, or by standard printing press equipment. The polyamide resin film can be applied to one or to both sides of the shipping sack. The polyamide can be applied to these surfaces as a broad, continuous film or in a pattern, for example, a pattern of stripes or a grid-like pattern, calculated to economize on the amount of polyamide employed while at the same time providing effective increase in coefficient of friction.

In order to test the effectiveness of the present invention, shipping sacks were manufactured from the reinforced film described in the above-identified Patent Application Ser. No. 307,417. The sacks were of a size which would accommodate 100 pounds of whole corn. The sacks were filled with the corn and securely closed. Sacks of this size and weight filled with whole corn were tested on an inclined angle tester. Half of the sacks were painted, 15 inches wide by the length of the bag on both faces thereof, with the polyamide solvent solution of the present invention. The remainder of the bags were not so coated. The coating solution consisted of a 20% by weight solution of Versamid 712 in a 50/50 mixture of isopropyl alcohol and heptane.

The testing apparatus consisted of a moveable platform hinged at one end with a cable attached to the opposite end. The cable was attached to a hand operated winch which, in use, raises the platform. In use, a flat sheet of test film identical to that employed in making the sacks was secured to the platform. This test film was not coated with polyamide. A loaded bag is placed at one end of the platform and the winch is activated until loaded bag slides from the platform. The angle of the platform from the horizontal is observed. The net result of this test revealed that shipping sacks not containing a film of polyamide on the surface thereof began movement to the end of the platform beginning at about 20° from the horizontal. On the other hand, identical sacks having the polyamide coating of the present invention did not begin to slide down the inclined plane until it had reached 45° to the horizontal. In this instance the test film on the inclined plane also contained a film of polyamide. This amounts to an improvement of about 125%. The test was run again, this time adding ordinary dust to the surface of the inclined plane in order to simulate some use environments. This condition resulted in a decrease in the coefficent of friction, however, the improvement over an untreated bag was still significant.

A test was also run in order to evaluate the stability of loaded bags on a pallet transported by a lift truck. The 100 pound corn loaded bags were arranged on a pallet in an interlocking fashion, four bags per layer, five layers high, for a total of 20 bags. The lift truck transported the load through a series of types of travel, which included right angle and 360 degree test turns at moderate speeds. None of the bags should fall off during these maneuvers. Under identical conditions of load and lift truck speed and type of travel, the sacks treated in accordance with the present invention on both sides of the bag, successfully passed the test without any bag slipping from the pallet. On the other hand, identical untreated sacks under the same travel conditions, slid off the pallet during the test.

This demonstrates that pallet stability and bag stack integrity is significantly improved by the technique of the present invention.

What is claimed is:

1. A product sack comprising an envelope of plastic film having at least one surface thereof at least partially coated with a thin layer of a slip-resistant thermoplastic polyamide resin.

2. The sack of claim 1 wherein said polyamide is formed from dimerized fatty acids and one or more aliphatic polyamines.

3. The sack of claim 2 wherein said plastic film comprises a polyolefin film.

4. The sack of claim 3 wherein said film is a composite comprising a pair of co-extruded films having a heat-softenable inner layer, a plurality of machine-direction oriented fibers therebetween having a selected first denier and a selected first spacing therebetween, and a single transverse-direction fiber disposed as parallel reaches connected by 180° loops at each end, said parallel reaches having a selected second spacing therebetween, said loops being entirely enclosed by said pair of films, and said transverse-direction fiber having a selected second denier.

5. The sack of claim 4 wherein said films are of polyethylene and said fibers of polypropylene.

6. The sack of claim 5 wherein two opposite surfaces of said envelope are coated with said polyamide.

7. The sack of claim 1, wherein said thin layer consists essentially of said slip-resistant thermoplastic polyamide resin.

8. A method of increasing the stabilization against motion of at least one loaded shipping sack relative to surfaces in contact therewith, comprising, applying to at least one surface of said shipping sack a thin layer of a slip-resistant thermoplastic polyamide resin.

9. The method of claim 8 wherein said sack is comprised of an envelope of plastic film.

10. The method of claim 8, wherein said thin layer consists essentially of said slip-resistant thermoplastic polyamide resin.

* * * * *